US006855044B2

(12) United States Patent
Ruestow

(10) Patent No.: US 6,855,044 B2
(45) Date of Patent: Feb. 15, 2005

(54) BURR FOR PREPARING A HOMOGENEOUS PULPSTONE SURFACE

(75) Inventor: Brian A. Ruestow, Orchard Park, NY (US)

(73) Assignee: F.W. Roberts Manufacturing Company, Inc., Lockport, NY (US)

( * ) Notice: Subject to any disclaimer, the term of this patent is extended or adjusted under 35 U.S.C. 154(b) by 320 days.

(21) Appl. No.: 09/822,639

(22) Filed: Mar. 30, 2001

(65) Prior Publication Data

US 2002/0151263 A1 Oct. 17, 2002

(51) Int. Cl.[7] ..... B24B 47/26
(52) U.S. Cl. ..... 451/443
(58) Field of Search ..... 451/443, 92; 125/11.03, 125/11.01, 11.18; 241/11, 28, 29, 261.2

(56) References Cited

U.S. PATENT DOCUMENTS 994,603 A * 6/1911 Potter ..... 125/11.03
1,118,671 A * 11/1914 Millard ..... 125/11.03
1,268,624 A * 6/1918 Riley ..... 125/11.03
3,608,536 A * 9/1971 Roberts, Jr. ..... 125/11.03
3,612,413 A * 10/1971 Perry ..... 241/28
3,620,462 A * 11/1971 Dooley, Jr. ..... 241/294
3,734,419 A * 5/1973 Cryderman ..... 241/282
3,776,475 A * 12/1973 Perry ..... 241/33
4,595,150 A * 6/1986 Aario ..... 241/282
5,453,041 A * 9/1995 Oliver ..... 451/541
5,738,569 A * 4/1998 Mackowsky ..... 451/56
6,241,169 B1 * 6/2001 Bjorkqvist ..... 241/24.29

FOREIGN PATENT DOCUMENTS

GB 2 092 474 8/1982

OTHER PUBLICATIONS

Norton Canada, "Types of Burrs", http://www.norton–canada.ca/pulpstone_info/tech_06/sharpen_2.html and sharpen_3.html, Downloaded and printed on Dec. 18, 2000.
F.W. Roberts Manufacturing Co., Inc. Brochure: "Roberts Pulpstone Burrs", pp. 1–7, Sep., 1973.

* cited by examiner

*Primary Examiner*—Lee D Wilson
(74) *Attorney, Agent, or Firm*—Hodgson Russ LLP

(57) ABSTRACT

An improved burr for sharpening the grinding surface of a pulpstone includes a novel tooth configuration for better wear of the burr and enhanced grinding properties of the pulpstone. The profile configuration of the burr teeth has a truncated tip portion in the form of a rounded tip portion, a flat tip portion, or an obtusely angled tip portion to avoid a sharply pointed tip. The tip portion connects opposite sides of the tooth, with the sides forming either a symmetrical or an asymmetrical tooth profile using linear, convex involute, and concave involute side configurations. The present invention comprises a further improvement to a pulpstone sharpening burr, wherein the lead angle of the burr teeth changes periodically over the axial length of the burr to provide the pulpstone with a wave-like groove pattern.

2 Claims, 6 Drawing Sheets

BACKGROUND PRIOR ART

BACKGROUND PRIOR ART

BACKGROUND PRIOR ART

BURR FOR PREPARING A HOMOGENEOUS PULPSTONE SURFACE

FIELD OF THE INVENTION

The present invention relates generally to pulpstones for producing wood pulp used in the paper industry, and more particularly to improved sharpening burr tooth configurations for preparing a more homogeneous grinding surface on a pulpstone.

BACKGROUND OF THE INVENTION

The historical development and use of paper as a means to record human events is extremely rich and illustrious. However, most of the technological advances associated with papermaking have evolved slowly, or have sprouted only after long time periods have passed. For instance, until 1803, nearly two-hundred and fifty years after the development of the printing press, hand paper production methods developed by the Chinese over two-thousand years ago remained the primary means by which paper was produced. In 1803 mechanical methods to produce paper were developed. Although these newer mechanical methods were themselves viewed as a boon to the paper production industry, they actually exacerbated paper shortage problems because they increased the demand for vegetative fibers, the essential ingredient used in the production of paper.

In 1843, Friedrich Gottleib Keller addressed the vegetative fiber shortage problem by devising a method and apparatus for producing and manufacturing wood pulp using a stone grinding wheel known as a "pulpstone". Keller's invention was timely because the Industrial Revolution was just entering full swing and demand for paper fiber was high. As a result, pulp production facilities having huge pulpstones were constructed for continuously grinding massive amounts of wood into pulp. Today, Keller's pulpstone grinding methods remain relatively unchanged, except for increases in capacity and efficiency due to refinements in grinder design. In fact, pulpstones are still used to produce large amounts of the wood pulp used in paper products today. FIG. 1 shows a typical wood pulp grinder 10 comprising a rotating pulpstone 12 and a plurality of pushers 14 for pressing logs 9 against an outer grinding surface 12A of the pulpstone. As seen in FIG. 1, pulpstone 12 rotates in a counterclockwise direction and logs 9 are arranged such that their longitudinal axes are parallel to the axis of rotation of the pulpstone. As pulpstone 12 rotates, logs 9 are fed under pressure by pushers 14 into engagement with pulpstone surface 12A to produce wood pulp.

As can be seen in FIG. 2, pulpstone 12 generally includes abrasive grains 15 held together by a bonding material 16, and are typically manufactured from either ceramic or cement bonded abrasive. Pulpstone surface 12A is shown in detail as including alternating land areas 17 and groove areas 18. As pulpstone 12 rotates and the timber 9 is pushed against pulpstone surface 12A, land areas 17 come into contact with the timber and groove areas 18 pass over the surface of the timber, thereby creating oscillation between mechanical compression and decompression that generates heat. The heat softens the lignin of the wood and the rotational forces acting on the timber loosen and remove the wood fiber. Because of the extreme pressures, high frictional forces, and heat generated during the grinding of the timber, land areas 17 of pulpstone surface 12A eventually begin to wear and widen, and the abrasive grains 15 begin to dull. The extent of such surface wear often varies over the axial length of pulpstone 12. Consequently, more and more energy must be expended in order to maintain a consistent quality and output of pulp. Thus, the surface quality and groove pattern of the pulpstone play a very critical role in efficient production of the desired quality pulp. It is, therefore, extremely desirable to ensure that the land/groove pattern on the pulpstone surface is maintained by regular "sharpening" or "dressing" of the pulpstone surface.

The term "pulpstone sharpening" is a misnomer; pulpstone sharpening does not actually sharpen the abrasive of a pulpstone. Rather, pulpstone sharpening fractures the softer bonding material of the pulpstone to remove the dull, older abrasive grains and to uncover the sharper, newer grains and to maintain the desired grooved pattern.

Referring to FIG. 3 of the drawings, a known procedure for sharpening a pulpstone is illustrated. To sharpen a pulpstone, a sharpening burr 20 is journaled in a forked end 19 of a cross-slide (not shown), which in turn mounted on a traversing carriage of a lathe (also not shown) such that the burr's axis of rotation is parallel to that of the pulpstone. As seen in FIG. 4, burr 20 has a plurality of spaced apart teeth 22 on its outer peripheral surface that can be forced into pulpstone surface 12A to a predetermined depth by adjustment of the cross-slide mechanism. Once burr 20 has been aligned at a side edge of pulpstone 12 and the burr depth has been set, the pulpstone is rotated, thereby imparting rotational motion to the sharpening burr. Burr 20 is then caused to traverse linearly across pulpstone surface 12A as indicated by the bi-directional arrows in FIG. 3. The traversal of sharpening burr 20 under pressure forms a pattern in pulpstone surface 12A by removing the old, abrasive grains and uncovering the sharp, new abrasive grains. The traversal process is repeated several times with a new sharpening burr as necessary to produce the desired pulpstone surface pattern. During the pulpstone sharpening process, the penetration depth of sharpening burr teeth 22 is critical. Proper tooth penetration depth fractures and removes abrasive grains on the surface of a pulpstone, however penetration that is too deep tends to fracture the deeper pulpstone surface bonds, creating wide grooves that promote pulpstone surface instability. Wide pulpstone grooves are undesirable because they produce long vegetative fibers and fiber bundles that are associated with lower grade pulps. In addition, pulpstone surface instability is also viewed as undesirable since it typically causes the premature wear of the pulpstone surface and failure of the groove pattern. Thus, pulpstone surface pattern and groove depth are viewed as important factors for manufacturing consistent and high quality pulps.

Pulpstone sharpening also serves several additional useful purposes. First, sharpening reduces the grinding surface area of a pulpstone, lowering energy consumption. Second, sharpening controls the oscillatory frequency of compression and decompression of the wood fibers, thus controlling the requisite heat that is used to release wood fibers from the lignin. Third, pulpstone sharpening cleans the pulpstone pores and prevents grinding surface overheating, cracking, and premature wear by carrying water to the grinding zone for cooling and lubricating purposes. Finally, pulpstone sharpening and groove pattern help to carry pulp out of the grinding zone.

Pulpstone sharpening burrs, for example burr 20 in FIGS. 3 and 4, have undergone very few changes over the past century, and there are currently four basic types in use today: spiral, diamond, fluted, and threaded. Spiral burrs have teeth that run parallel with one another and at an angle (known as the "lead angle") to the rotational axis of the burr. When applied to the surface of a pulpstone, the spiral burr produces a series of diagonal impressions across the surface of the pulpstone. During grinding, the diagonal pattern formed on the pulpstone with a spiral burr removes wood fibers using a semi-shearing action. Diamond toothed burrs have teeth that form a pyramid or diamond shape. They are used primarily for truing pulpstones and for removing patterns on a pulpstone. Fluted burrs, such as burr 20 shown in FIG. 4, have teeth that run parallel to the rotational axis of the burr. When applied to a pulpstone surface, the fluted burr produces a pattern that is parallel to the rotational axis of the pulpstone. During grinding, the fluted pattern of the pulpstone removes long coarse fibers from the wood. A threaded burr produces a series of rings around the face of a pulpstone that produce a very light shearing action resulting in the production of a very high quality pulp. Pulpstone sharpening burrs are typically machined from a steel shell that is then heat treated for hardness and stress relief.

The teeth of a pulpstone sharpening burr play perhaps the most critical role in the production of wood pulp because they actually create the patterns that have such profound effects upon the amount, quality, and consistency of the final wood pulp product. Burr teeth function by fracturing pulpstone bond posts between abrasive grains, thereby forming the abrasive pattern on the surface of a pulpstone. Current and past tooth configurations have traditionally been exclusively "pointed-triangular", as shown in FIG. 5. By "pointed-triangular" it is meant that the burr tooth 22 is formed by two converging opposite planar sides 23A and 23B that intersect at a substantially pointed tip 24. The included angle of tip 24 formed by the intersection of sides 23A and 23B is acute, ranging from 20° to 70°. Pointed-triangular tooth configurations suffer from two main drawbacks. First, because they are extremely sharp and pointed, they tend to wear unevenly when traversed across a pulpstone surface. Thus, pointed triangular teeth ultimately place an uneven pattern on the surface of the pulpstone, a result that is particularly undesirable because an uneven pulpstone pattern produces inconsistent grades of pulp depending upon axial position along the surface of the pulpstone. Second, pointed-triangular teeth can cause "deep bond breakage" in the surface of the pulpstone. Deep bond breakage is undesirable because it causes pulpstone surface and groove pattern instability that tends to promote the premature wear of the pulpstone. Because of deep bond breakage, a pulpstone must be taken offline and re-sharpened more frequently, resulting in more frequent equipment downtimes and lowered production outputs.

Thus, developing a sharpening burr that reduces the incidence of deep bond breakage and withstands wear such that a homogenous pattern can be placed across the surface of a pulpstone would be extremely beneficial to the pulpwood processing industry in terms of increased pulp quality and increased pulp production.

SUMMARY OF THE INVENTION

It is, therefore, an object of the present invention to provide an improved pulpstone sharpening burr that slows pulpstone wear by preventing the incidence of deep bond breakage on the surface of a pulpstone during sharpening.

It is another object of this invention to provide an improved pulpstone sharpening burr that is itself resistant to wear such that the burr forms a more homogeneous groove pattern across the surface of a pulpstone.

In view of these objects and in accordance with the present invention, a sharpening burr having a plurality of teeth is improved by changing the profile configuration of the teeth from the traditional pointed-triangular configuration to a configuration having a truncated tip portion in the form of a rounded tip portion, a flat tip portion, or an obtusely angled tip portion. The tip portion connects opposite sides of the tooth, with the sides forming either a symmetrical or an asymmetrical tooth profile. Symmetrical side configurations include linear—linear, convex involute—convex involute, and concave involute—concave involute. Asymmetrical side configurations include linear—convex involute, linear—concave involute, and convex involute—concave involute.

The present invention also encompasses a further improvement to a pulpstone sharpening burr, wherein the lead angle of the burr teeth changes periodically over the axial length of the burr to provide the pulpstone with a wave-like groove pattern.

BRIEF DESCRIPTION OF THE DRAWINGS

The nature of the present invention will now be more fully described in the following detailed description of the preferred embodiments taken with the accompanying drawings and figures, in which.

DETAILED DESCRIPTION OF THE INVENTION

Figure 4:
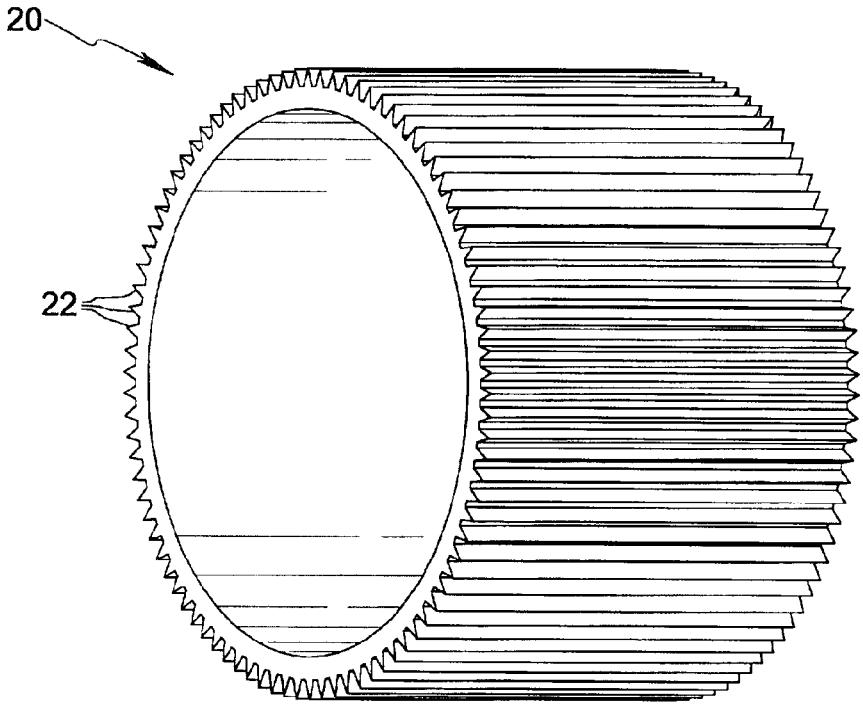
FIG. 4 PRIOR ART
FIG. 4 is a perspective view of a fluted sharpening burr of the prior art.

Attention is directed generally to FIGS. 6A through 11C of the drawings, which depict various burr tooth configurations in accordance with the present invention. The burr teeth are shown in enlarged profile view, and it will be understood that the burr teeth are formed on an outer surface of a cylindrical body just as pointed-triangular teeth 22 are formed on an outer surface of prior art burr 20 depicted in FIG. 4.

Referring more specifically to FIGS. 6A–6F, innovative burr tooth configurations in accordance with first through sixth embodiments of the present invention are shown and identified respectively by reference numerals 101, 102, 103, 104, 105, and 106. Teeth 101–106 are similar to each other in that each includes a rounded tip portion 110 as a departure from the acutely angled pointed-triangular tip of the prior art. The rounded tip portion 110, which may simply be formed as a radius, improves the tooth's ability to hold its shape and height as compared with pointed-triangular teeth of the prior art because the cordal thickness of the tip increases at a greater rate from the apex of the tooth moving toward the base of the tooth until rounded tip portion 110 merges with the sides of the tooth. The radius of tip portion 110 is chosen small enough such that the tooth still has the ability to form a major portion of the pattern land in the pulpstone. An important advantage of rounded tip portion 110 is that the tooth shape wears less and remains more consistent as the burr traverses the pulpstone, thereby forming a more consistent pattern groove depth over the entire pulpstone surface. Ultimately, this allows for better control of the composite wood fiber mix produced in the grinding operation by limiting the number of coarse and fine fiber fractions, making it easier to produce pulp fiber that is closer to the target specification. Another advantage of rounded tip portion 110 is that it reduces the incidence of deep bond breakage, thereby increasing the stability of the pulpstone surface and groove pattern. Thus, the embodiments of FIGS. 6A–6F improve the wood pulp production process in two ways: first by creating a homogeneous pulpstone surface that improves overall pulp quality, and second by reducing the incidence of equipment down times that are required to perform pulpstone sharpening procedures.

Figure 5:
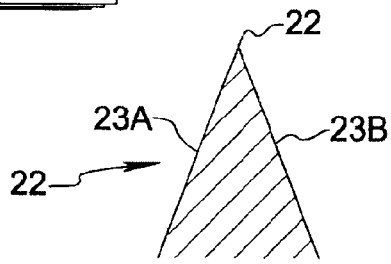
FIG. 5 PRIOR ART
FIG. 5 is an enlarged cross-sectional view of a pointed-triangular burr tooth of the prior art.

The embodiments of FIGS. 6A–6F differ from each other with respect to the configuration of the sides of the tooth that are connected by rounded tip portion 110. Tooth 101 of FIG. 6A includes a pair of symmetrical sides 111A and 111B that are linear in profile view, similar to the sides 23A, 23B of prior art tooth 22 shown in FIG. 5. Since tooth 101 produces the same land top width as a conventional tooth, the resulting available grinding area on the pulpstone is not compromised. Linear sides 111A, 111B are simpler to machine than other side configurations to be discussed at present.

Figure 6A:
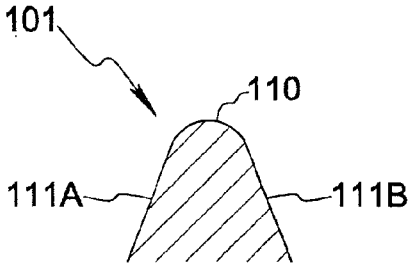
FIG. 6A is an enlarged cross-sectional view of a burr tooth formed in accordance with a first embodiment of the present invention.
Figure 6B:
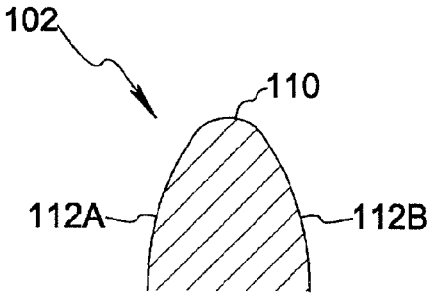
FIG. 6B is an enlarged cross-sectional view of a burr tooth formed in accordance with a second embodiment of the present invention.

Tooth 102 of FIG. 6B includes a pair of symmetrical sides 112A and 112B that each trace a convex involute when viewed in profile. The symmetrical convex involute sides 112A, 112B have a normal pressure angle ranging from 20° to 70°. The form of tooth 102 is more robust in cross-section than the form of prior art tooth 22 of FIG. 5, and gives the tooth more surface area over which to spread the inherent wear that is caused while the burr is in contact with the rotating pulpstone. Since the work performed by the burr in terms of abrasive grains dislodged by breaking the bond material between grains can be correlated to the available surface area of the tooth form, tooth 102 has the potential to do more work before exhibiting excessive wear. Tooth 102 produces a wider open groove between pattern lands in the pulpstone surface, and thus is desirable in instances where it is important for the grooves to carry large volumes of shower water through the grinding zone to better transport pulp fibers and dissipate heat.

Figure 6C:
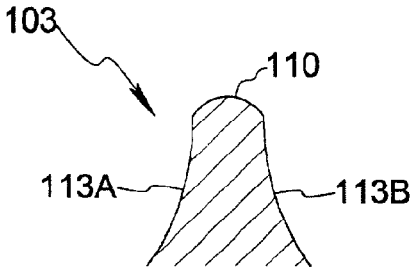
FIG. 6C is an enlarged cross-sectional view of a burr tooth formed in accordance with a third embodiment of the present invention.

FIG. 6C shows tooth 103 as including opposite sides 113A, 113B that are in the form of symmetrical concave involutes when viewed in profile. The primary advantage of this configuration is that it places a stronger groove pattern in the pulpstone because it produces an "involute-like" (not a pure involute) shaped land in the groove pattern.

Figure 6D:
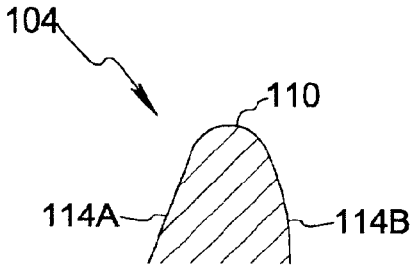
FIG. 6D is an enlarged cross-sectional view of a burr tooth formed in accordance with a fourth embodiment of the present invention.

Tooth 104 shown in FIG. 6D has sides 114A, 114B that are asymmetrical about an imaginary radial line extending from the axis of rotation of the burr through the center of rounded tip portion 110. A tooth form with asymmetrical sides provides a way to combine positive attributes to the leading side and trailing side of the tooth. Tooth 104 includes a convex involute leading side 114B and a linear trailing side 114A, giving it extra surface area and wear resistance on the side of the tooth that benefits most from these qualities.

Figure 6E:
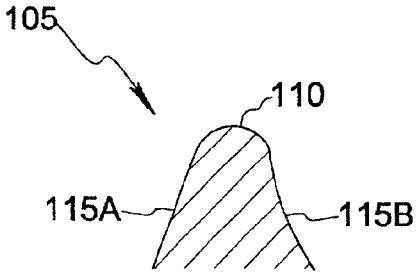
FIG. 6E is an enlarged cross-sectional view of a burr tooth formed in accordance with a fifth embodiment of the present invention.

Referring now to FIG. 6E, tooth 105 includes asymmetrical sides 115A, 115B chosen to shape the wall of the groove in the pulpstone differently on each side. This is valuable because of the dynamic forces directed against the pulpstone groove pattern during the grinding process. As a pattern land sweeps across the face of a log during grinding, there is a reactionary tangential force against the land. If the tangential force exceeds the strength of the land, the pattern can become broken away from the pulpstone surface. Thus leading side 115B is a concave involute in profile configuration to form a more robust involute-like wall on the trailing side of the pulpstone pattern land, while trailing side 115A is linear to form a conventionally shaped groove wall on the leading side of the pulpstone pattern land. This extra cross-sectional thickness on the trailing side of the pulpstone land can provide added resistance to the grinding force exerted on the land to help prevent breaking away of abrasive grains from the pulpstone surface. Tooth 105 yields less difference in groove volume, total active grains, and grinding area relative to a pointed-triangular tooth of the prior art, as compared with a symmetrical concave involute tooth form such as tooth 103 shown in FIG. 6C. Consequently, the operational parameters are similar to those established for a conventional burr, with added strength at the trailing wall of the pulpstone pattern land.

Figure 6F:
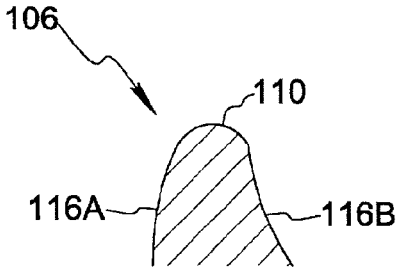
FIG. 6F is an enlarged cross-sectional view of a burr tooth formed in accordance with a sixth embodiment of the present invention.
Figure 7A:
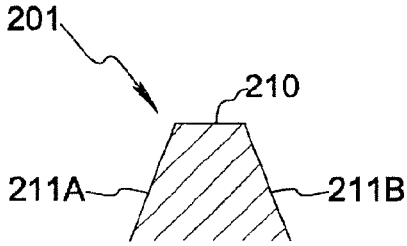
FIG. 7A is an enlarged cross-sectional view of a burr tooth formed in accordance with a seventh embodiment of the present invention.
Figure 7B:
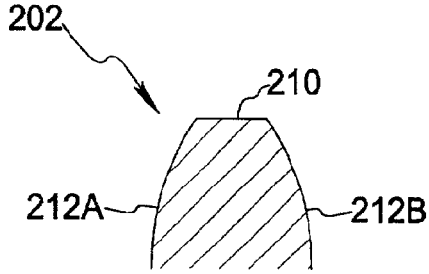
FIG. 7B is an enlarged cross-sectional view of a burr tooth formed in accordance with an eighth embodiment of the present invention.
Figure 7C:
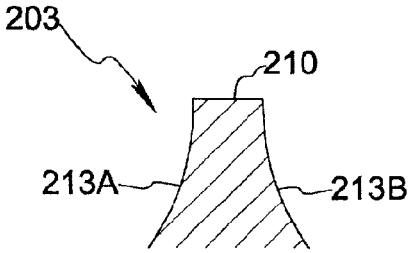
FIG. 7C is an enlarged cross-sectional view of a burr tooth formed in accordance with a ninth embodiment of the present invention.
Figure 7D:
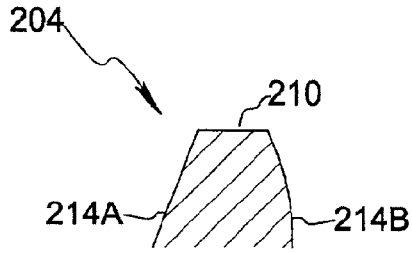
FIG. 7D is an enlarged cross-sectional view of a burr tooth formed in accordance with a tenth embodiment of the present invention.
Figure 7E:
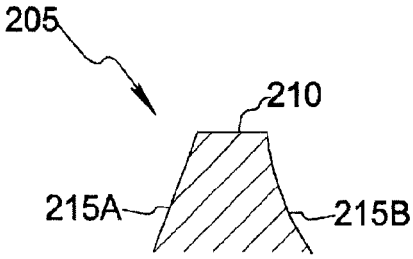
FIG. 7E is an enlarged cross-sectional view of a burr tooth formed in accordance with an eleventh embodiment of the present invention.
Figure 7F:
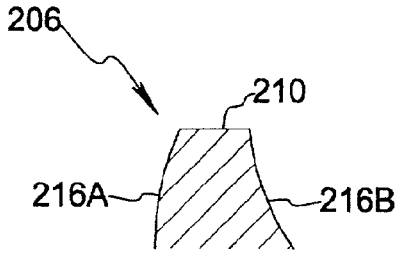
FIG. 7F is an enlarged cross-sectional view of a burr tooth formed in accordance with a twelfth embodiment of the present invention.
Figure 8A:
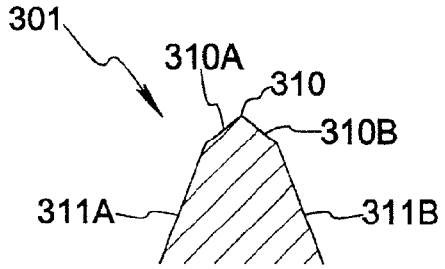
FIG. 8A is an enlarged cross-sectional view of a burr tooth formed in accordance with a thirteenth embodiment of the present invention.
Figure 8B:
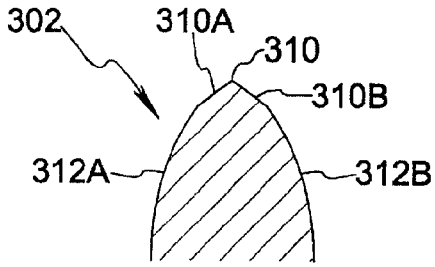
FIG. 8B is an enlarged cross-sectional view of a burr tooth formed in accordance with a fourteenth embodiment of the present invention.
Figure 8C:
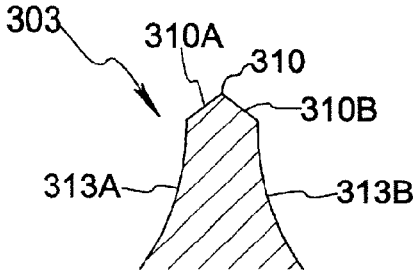
FIG. 8C is an enlarged cross-sectional view of a burr tooth formed in accordance with a fifteenth embodiment of the present invention.
Figure 8D:
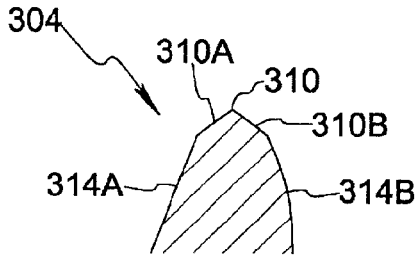
FIG. 8D is an enlarged cross-sectional view of a burr tooth formed in accordance with a sixteenth embodiment of the present invention.
Figure 8E:
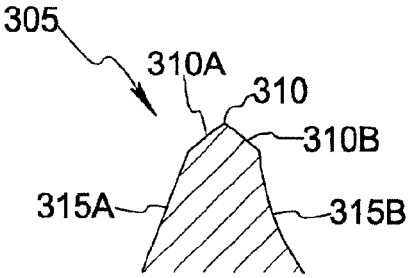
FIG. 8E is an enlarged cross-sectional view of a burr tooth formed in accordance with a seventeenth embodiment of the present invention.
Figure 8F:
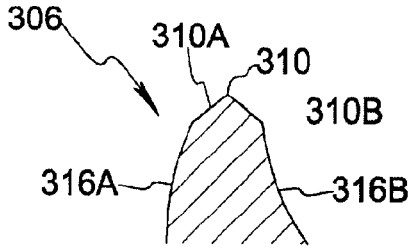
FIG. 8F is an enlarged cross-sectional view of a burr tooth formed in accordance with an eighteenth embodiment of the present invention.

Asymmetrical burr tooth 106 shown in FIG. 6F combines a concave involute leading side 116B with a convex involute trailing side 115A. The shape of leading side 116B adds strength to the trailing wall of the pulpstone pattern land, while the convex involute trailing side gives the leading wall of the pulpstone pattern land a concave shape that ensures sufficient groove volume.

Teeth 201, 202, 203, 204, 205, and 206 illustrated in FIGS. 7A–7F correspond respectively to teeth 101, 102, 103, 104, 105, and 106 with regard to the profile configuration of their opposite sides, and thus experience the same benefits discussed above. Tooth 201 has symmetrical linear sides 211A, 211B; tooth 202 has symmetrical convex involute sides 212A, 212B; tooth 203 has symmetrical concave involute sides 213A, 213B; tooth 204 has a convex involute leading side 214B and a linear trailing side 214A; tooth 205 has a concave involute leading side 215B and a linear trailing side 215A; and tooth 216 has a concave involute leading side 216B and a convex involute trailing side 216A. Teeth 201–206 differ from teeth 101–106 in that they each include a flat tip portion 210 connecting the sides of the tooth and running parallel to the base of the tooth. The relative size of flat tip portion 210 depicted in FIGS. 7A–7F is exaggerated, and the actual size of flat tip portion 210 is much smaller in relation to the remainder of the tooth. This type of configuration exhibits tremendously greater wear resistance compared to the pointed-triangular tooth form of the prior art, thereby producing a more consistent groove pattern across the surface of the pulpstone. Moreover, deep bond breakage in the pulpstone composite abrasive is significantly reduced by the elimination of a sharp point in the tooth.

Teeth 301, 302, 303, 304, 305, and 306 illustrated in FIGS. 8A–8F also correspond respectively to teeth 101, 102, 103, 104, 105, and 106 with regard to the profile configuration of their opposite sides, and thus experience the same benefits discussed above. Tooth 301 has symmetrical linear sides 311A, 311B; tooth 302 has symmetrical convex involute sides 312A, 312B; tooth 303 has symmetrical concave involute sides 313A, 313B; tooth 304 has a convex involute leading side 314B and a linear trailing side 314A; tooth 305 has a concave involute leading side 315B and a linear trailing side 315A; and tooth 316 has a concave involute leading side 216B and a convex involute trailing side 316A. In contrast to the rounded tip portion 110 and flat tip portion 210 of the previous embodiments, a pointed tip portion 310 is common to teeth 301–306, and includes a pair of surfaces 310A and 310B that intersect to form an obtuse angle when viewed in profile. The angled tip portion 310, due to its obtuse design, has the ability to hold shape and height better and cause less deep bond breakage than the traditional acutely angled pointed triangular tooth of the prior art. The angled tip portion 310 transitions to the sides at a location that allows the tooth sides to perform their intended pattern-forming function with respect to the pulpstone. Accordingly, a more homogenous pattern is created across the pulpstone surface resulting in the production of more homogenous wood pulp fibers.

Figure 1:
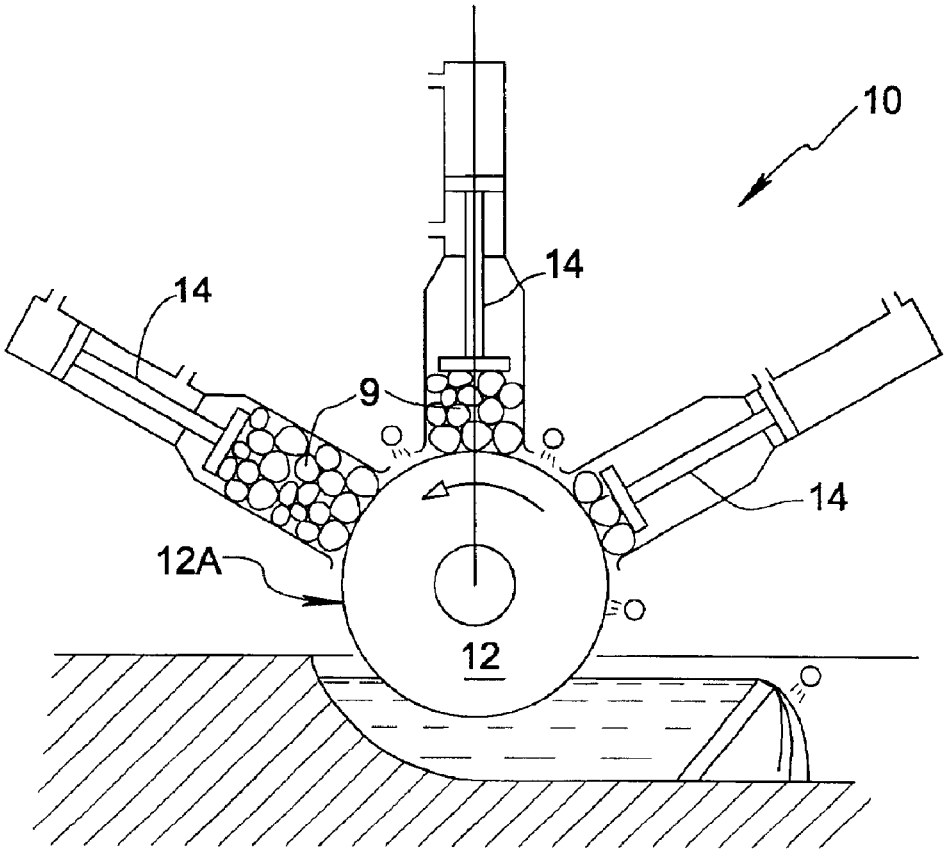
FIG. 1 is a schematic view showing an example of a wood pulp grinding apparatus known in the art.
Figure 2:
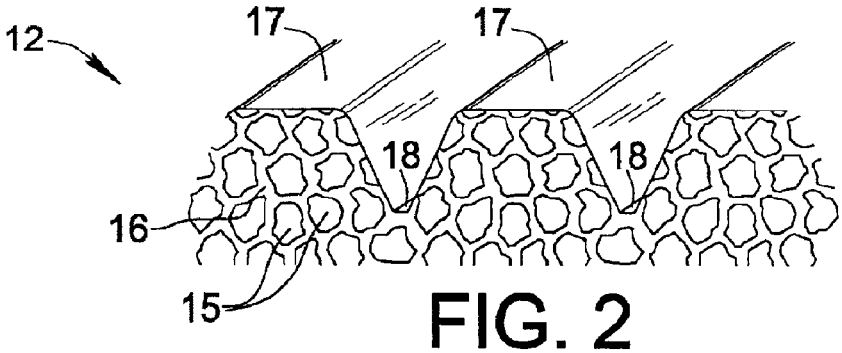
FIG. 2 is an enlarged cross-sectional view of a pulpstone surface showing a groove pattern formed therein.
Figure 3:
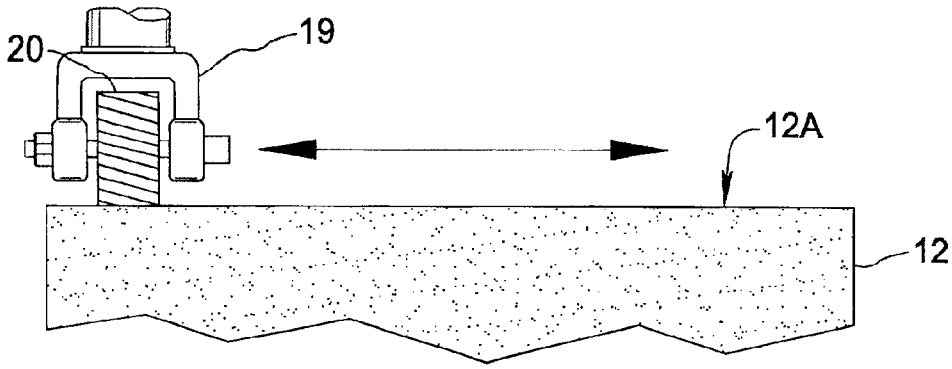
FIG. 3 is a schematic view showing a pulpstone sharpening operation using a pulpstone sharpening burr as is known in the art.
Figure 9:
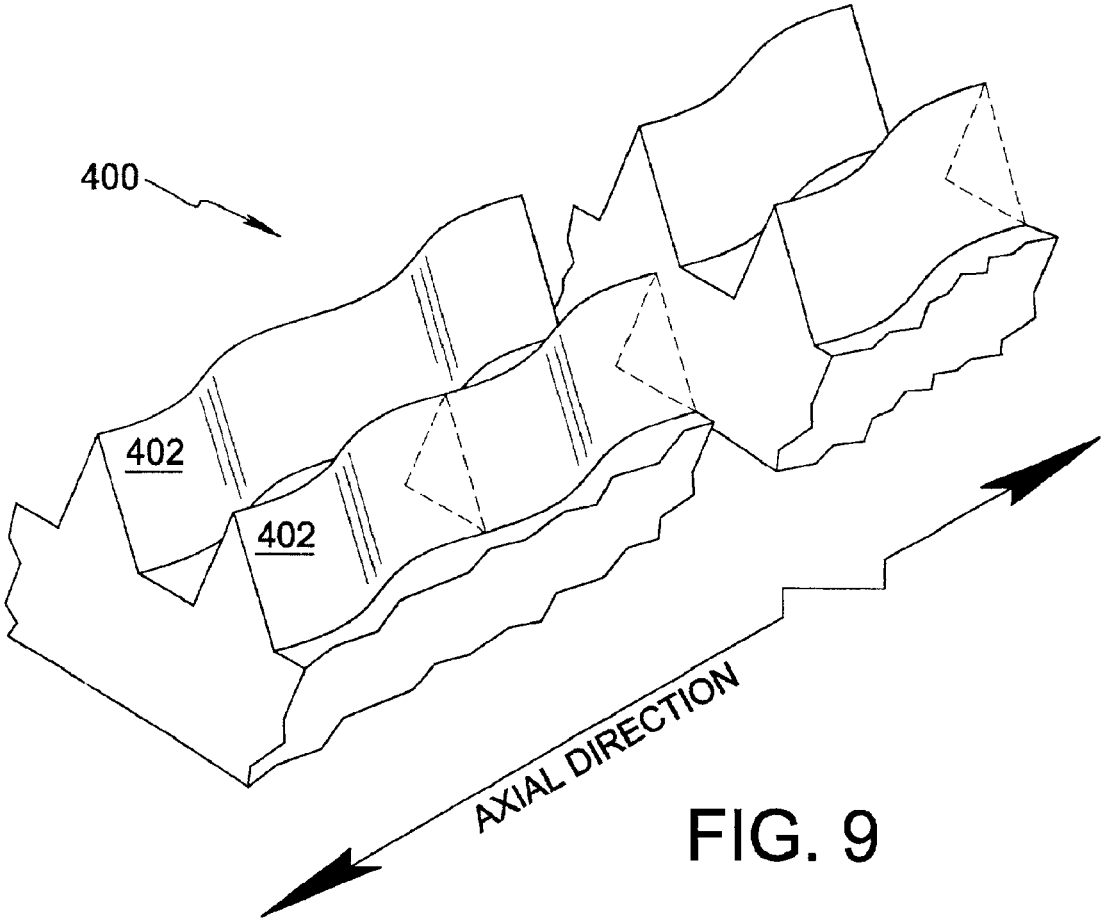
FIG. 9 is an enlarged partial perspective view of a pulpstone sharpening burr formed in accordance with a nineteenth embodiment of the present invention.

Reference is now made to FIG. 9, wherein a portion of a burr 400 is shown to illustrate another improvement to pulpstone burr technology according to the present invention. As mentioned above with regard to background art, the teeth of a spiral burr extend parallel each other and at a lead angle relative to the rotational axis of the burr. Heretofore, burrs have been made such that the lead angle of a burr remains constant from one end of the burr to the other, without deviation along the length of the burr. As will be apparent from FIG. 9, which shows a pair of adjacent teeth 402 of burr 400, the lead angle of teeth 402 varies in an undulating fashion over the axial length of the burr. The lead angle of each tooth preferably changes in a regular periodic manner, most preferably in a sinusoidal manner, many times over the axial length of burr 400. This innovation can be practiced in combination with the traditional pointed-triangular tooth form as shown in FIG. 9, or with any other novel tooth forms, including but not limited to tooth forms disclosed herein. Burr 400 having undulating teeth 402 provides a corresponding wave-shaped groove pattern on the pulpstone surface, instead of the traditional straight-line pattern now employed. Those skilled in the art of wood pulp production realize that a "combing" mechanism takes place by the pulpstone pattern as the lignin softens and allows the wood fibers to be released in the grinding zone. More specifically, when a small lead angle is used, the wood fibers tend to be combed out in long strands, whereas when a large lead angle is used, the wood fibers tend to be combed out in shorter strands. Burr 400 having undulating teeth 402 is designed to provide the pulpstone surface with a groove pattern that yields a combination of both combing effects. During pulpstone patterning, the burr 400 must be permitted to shift phase back and forth axially along its journal axis in forked end 19 of the lathe cross-slide (see FIG. 3) to allow the burr to shift a sufficient amount to allow the tooth form on the burr to mesh properly with the undulating lead pattern that may already exist on the pulpstone surface; otherwise, the existing pattern on the pulpstone might be destroyed.

What is claimed is:

1. In a sharpening burr for dressing the grinding surface of a pulpstone, said sharpening burr comprising a cylindrical body having an outer surface and an axis of rotation, and a plurality of teeth formed on said outer surface for engaging said grinding surface of said pulpstone, the improvement comprising:

each of said plurality of teeth having a lead angle relative to said axis of rotation that varies with axial position along said cylindrical body, wherein said variation in said lead angle is a periodic variation.

2. The sharpening burr according to claim 1, wherein said variation in said lead angle is a sinusoidal variation.

* * * * *